US005725698A

United States Patent [19]

Mahoney

[11] Patent Number: 5,725,698

[45] Date of Patent: Mar. 10, 1998

[54] FRICTION BORING PROCESS FOR ALUMINUM ALLOYS

[75] Inventor: Murray W. Mahoney, Camarillo, Calif.

[73] Assignee: Boeing North American, Inc., Seal Beach, Calif.

[21] Appl. No.: 632,729

[22] Filed: Apr. 15, 1996

[51] Int. Cl.[6] ..... C22F 1/00

[52] U.S. Cl. ..... 148/695; 148/698; 148/697; 72/69; 72/71

[58] Field of Search ..... 148/695, 698, 148/697; 72/69, 71

[56] References Cited

U.S. PATENT DOCUMENTS

| | | | |
|---|---|---|---|
| 4,092,181 | 5/1978 | Paton et al. | 148/698 |
| 4,428,214 | 1/1984 | Head, Jr. et al. | 72/69 |
| 4,719,780 | 1/1988 | Ristimaki | 72/71 |
| 4,799,974 | 1/1989 | Mahoney et al. | 148/12.7 A |
| 5,460,317 | 10/1995 | Thomas et al. | 228/112.1 |

*Primary Examiner*—David A. Simmons
*Assistant Examiner*—M. Alexandra Elve
*Attorney, Agent, or Firm*—Charles T. Silberberg; John C. McFarren

[57] ABSTRACT

A friction boring process creates a corrosion resistant fine grain microstructure in the wall surfaces of holes bored in aluminum alloy materials. A rotating tool is inserted directly into the aluminum material, or into a pre-drilled pilot hole, at a sufficient rotational velocity and feed rate to cause working that extends beyond the diameter of the tool, frictional heating, and extraction of aluminum material by metal deformation rather than cutting action as with a conventional drill bit. Burring, smoothing, and otherwise removing aluminum material extracted from the hole may be performed by a finishing segment that limits insertion depth of the tool. Frictional heating generates a temperature sufficient for rapid recrystallization of the remaining worked metal to form a fine grain microstructure to a depth of about 2.5 mm in the hole surfaces. Corrosion protection is retained even if some fine grain material is removed during a subsequent reaming operation. Friction boring is fast, suitable for a wide variety of aluminum alloy compositions, and easily adaptable to initial fabrication of aluminum components or to field repair of assembled structures such as on aging aircraft. The process creates a fine grain corrosion and fatigue resistant surface microstructure in aluminum alloy holes without the use of peening, heat treatments, or environmentally objectionable chemicals and coatings.

18 Claims, 3 Drawing Sheets

FRICTION BORING PROCESS FOR ALUMINUM ALLOYS

TECHNICAL FIELD

The present invention relates to fine grain surface processing of aluminum alloys and, in particular, to a friction boring process for forming holes with surfaces having a corrosion inhibiting fine grain microstructure.

BACKGROUND OF THE INVENTION

Exfoliation corrosion of high strength aluminum alloys can occur when edges of the metal surfaces are exposed to environments containing acids and salts. Aircraft structures, for example, are particularly susceptible to exfoliation corrosion (which causes accelerated fatigue) around fastener holes and other edges, where transverse sections of the microstructure are exposed, corrosive solutions collect, and effective washing is difficult. As a result, exfoliation corrosion produces destructive effects that limit the useful life of aircraft components and other high strength structural aluminum parts.

In the prior art, U.S. Pat. No. 4,799,974 discloses a thermomechanical "Method of Forming a Fine Grain Structure on the Surface of an Aluminum Alloy." This method describes the accepted practice for creating a fine grain morphology on the surface of high strength aluminum alloy sheet material. The following steps, with only minor variations for expediency or cost considerations, are generally performed in conventional methods to achieve a fine grain is microstructure at the surface of aluminum alloys:

1) Solution treat the material at about 480° C. for 30 minutes to put all second phases into solution;
2) Age the material at about 400° C. for 8 hours to develop a duplex precipitate distribution of both fine and coarse precipitates;
3) Work the material at moderately low temperatures (rolling at less than about 200° C., for example, to reduce the thickness);
4) Recrystallize the worked material as rapidly as possible (by submersing in a salt bath at about 480° C. for 15 minutes, for example); and
5) Age the material at low temperature for about 24 hours, for example, to achieve appropriate strength levels (such as T-6 or T-7, for example).

The foregoing process steps, which are sometimes difficult and lengthy, can add considerably to the cost of producing a fine grain microstructure on the surface of an aluminum alloy. Furthermore, conventional surface processing techniques do not produce a fine grain microstructure for corrosion protection at locations such as sheet edges and fastener holes, which are the most susceptible sites for initiation of exfoliation corrosion. The conventional process steps listed above, including solution treatment and long time age, are not practical for localized microstructural control nor are they applicable to the particular geometry of hole surfaces. In addition, localized surface working procedures (such as shot peening or cold expansion, for example) do not impart uniform or sufficient work for corrosion resistance when applied to aluminum alloy edges and hole surfaces. Shot peening is limited, at best, to low aspect ratio holes (i.e., thin sheets having large diameter holes), and it can severely distort the hole geometry, thus requiring subsequent machining that results in removal of the worked surface. Cold expansion processes, commonly used to impart fatigue resistance to hole surfaces, do not effect localized deformation to initiate fine grain recrystallization, and thus do not provide improved corrosion resistance. As an alternative to surface processing, conventional through-thickness bulk processing can produce fine grain aluminum, but this process is also expensive and generally limited to 7000-series aluminum alloy sheet material having a thickness less than about 0.08 inch.

Applicant's co-pending application Ser. No. 530,541 filed Sep. 19, 1995 (allowed) discloses a method for creating a localized fine grain microstructure in transverse edge surfaces of aluminum alloys, including interior surfaces of high aspect ratio holes such as those found in aircraft structures. This method uses a ball peening tool in combination with localized recrystallization to form a free grain microstructure in edge surfaces of sheet material. Although this method is effective in producing a thin layer having a fine grain microstructure, it requires at least a two-step operation.

In addition to the limitations of prior art fine grain processing, new environmental restrictions prevent the use of coatings previously relied on to impart corrosion resistance to hole surfaces in aluminum alloys. Many of the chemicals used in such coating processes are now restricted or banned as harmful to the environment. Thus, there is a need for fast, effective, and environmentally acceptable methods of providing corrosion resistance in hole surfaces of aluminum alloy structures.

SUMMARY OF THE INVENTION

The present invention is a friction boring process for creating a corrosion resistant fine grain microstructure in the wall surfaces of holes bored in aluminum alloy materials. The process uses a rotating tool, comprising a shaft having helical threads similar to a screw auger, that causes metal deformation rather than a cutting action as with a conventional drill bit. The rotating tool is inserted directly into the aluminum material, or into a pre-drilled pilot hole in the material, at a sufficient rotational velocity and feed rate to cause working that extends beyond the diameter of the tool, frictional heating sufficient for recrystallization, and extraction of aluminum material to form a hole. The tool may include a reaming segment for finishing the hole after boring, and a finishing segment for limiting insertion depth of the tool, removing aluminum material extracted from the hole, and burring, grinding, smoothing, polishing, or otherwise finishing the top surface around the hole. Frictional heat from the process generates a temperature sufficient for rapid recrystallization of the worked metal that remains to form the wall surfaces of the hole. As a result, a layer of fine grain metal about 2.5 mm thick is formed in the hole surfaces. This relatively deep fine grain surface microstructure provides corrosion protection even if some fine grain material is removed during a subsequent reaming operation.

Friction boring to form holes with localized fine grain surface microstructures is inexpensive and easy to implement because it does not require the conventional steps of solution and age treatment, cold working, subsequent heating for recrystallization, and final age treatment. Furthermore, friction boring is suitable for a wide variety of aluminum alloy compositions. The process is fast and easily adaptable to initial fabrication of aluminum components or to field repair of assembled components, such as in place on aging aircraft.

A principal object of the invention is to impart corrosion and fatigue resistance to the surfaces of holes in aluminum alloy materials. A feature of the invention is a friction boring process that produces a fine grain microstructure in the wall surfaces of a hole. An advantage of the invention is the creation of a fine grain corrosion and fatigue resistant surface microstructure in aluminum alloy holes without the use of peening, heat treatments, or environmentally objectionable chemicals and coatings.

BRIEF DESCRIPTION OF THE DRAWINGS

For a more complete understanding of the present invention and for further advantages thereof, the following Detailed Description of the Preferred Embodiments makes reference to the accompanying Drawings, in which.

DETAILED DESCRIPTION OF THE PREFERRED EMBODIMENTS

Figure 1:
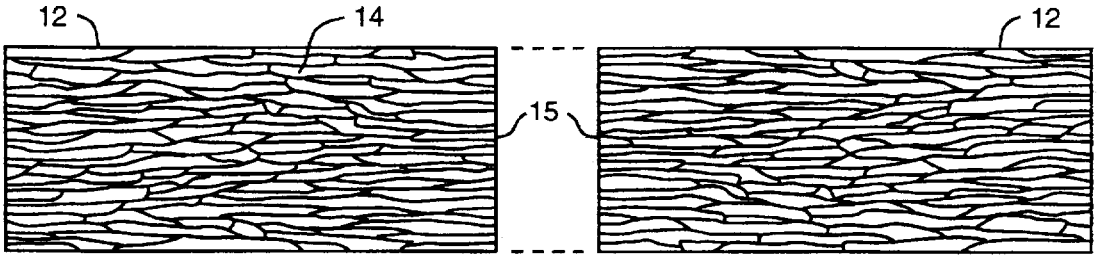
FIG. 1 is a schematic depiction of a cross section of a hole drilled in a conventionally processed aluminum alloy sheet having an elongated grain structure.
Figure 2:
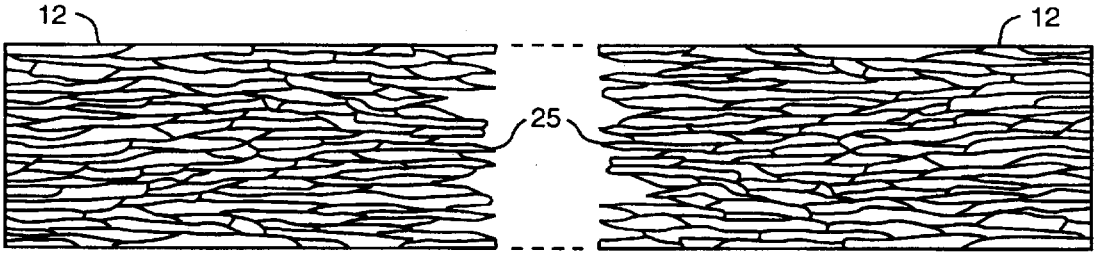
FIG. 2 is a schematic depiction of the aluminum alloy sheet of FIG. 1 showing exfoliation corrosion in the hole surfaces.

In a conventionally processed aluminum alloy sheet 12, as depicted in the schematic cross section of FIG. 1, the starting grain size is typically about 15 μm in the short through-thickness (or transverse) direction and about 50 μm in the rolling (or longitudinal) direction. These elongated, high aspect ratio grains 14 can be detrimental in a corrosive environment because the long grain boundaries facilitate propagation of corrosion over large distances. This is particularly true in hole surfaces 15, where the exposed transverse microstructure (i.e., across the grain) facilitates exfoliation corrosion, as depicted by corroded hole surfaces 25 in the schematic cross section of FIG. 2.

Producing a hole surface 15 with a fine grain corrosion resistant microstructure requires fundamentally different processes than those used for fine grain bulk or top surface processing of aluminum sheet material. A method using a ball peening tool in combination with localized recrystallization to form a fine grain microstructure in edge surfaces of sheet material is described in Applicant's co-pending application Ser. No. 530,541 filed Sep. 19, 1995 (allowed). The present invention, however, uses a rotating tool 30 having a friction boring segment 32 comprising a shaft having helical threads similar to a screw auger, as illustrated schematically in FIG. 3. Friction boring segment 32 is used to form a hole 44 in an aluminum alloy sheet 42, as illustrated schematically in FIG. 4, by a process of metal deformation rather than by a cutting action as with a conventional drill bit. In the prior art, a process of metal deformation for friction welding is described in U.S. Pat. No. 5,460,317 issued to Thomas et al.

Boring segment 32 is inserted directly into aluminum alloy sheet 42 (or into a pre-drilled pilot hole in sheet 42) at a sufficient rotational velocity and feed rate to cause working that extends beyond the diameter of boring segment 32, frictional heating sufficient for recrystallization, and extraction of aluminum material from sheet 42 to form hole 44 with surfaces 45. The material that forms boring segment 32 is harder than the sheet material 42 so that boring segment 32 is not significantly worn, spent, or deformed during the process. A flange or finishing segment 34 of tool 30 limits insertion depth of boring segment 32 and may include a surface 36 for burring, grinding, smoothing, polishing, or otherwise removing extracted material and finishing the surface around hole 44. Frictional heat from the boring process generates a temperature sufficient for rapid recrystallization of the worked metal that remains to form the wall surfaces 45 of hole 44. As a result, friction boring produces a corrosion resistant layer of fine grain metal about 2.5 mm deep in surfaces 45. This is a significantly deeper fine grain layer than has been achieved with peening methods. After a hole 44 has been formed by friction boring, a reaming operation may be utilized to finish the surfaces. Because of the relatively deep fine grain microstructure produced in surfaces 45 by the friction boring process, corrosion protection is retained even after some fine grain material has been removed during subsequent reaming and finishing operations.

Figure 3:
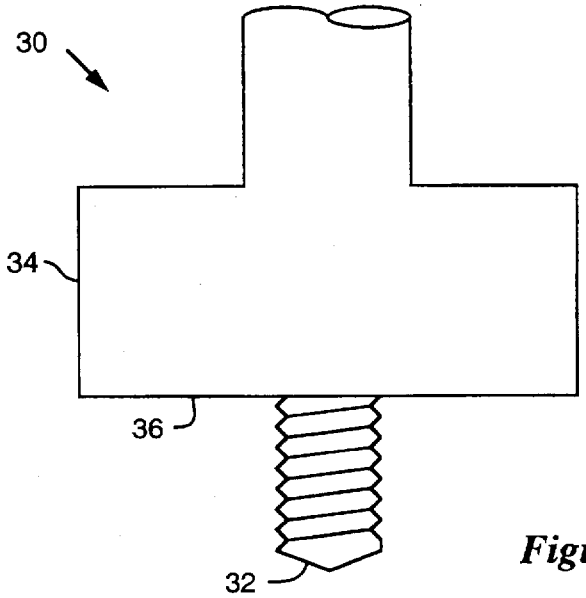
FIG. 3 is a schematic side view of a friction boring tool for use in the process of the present invention.
Figure 4:
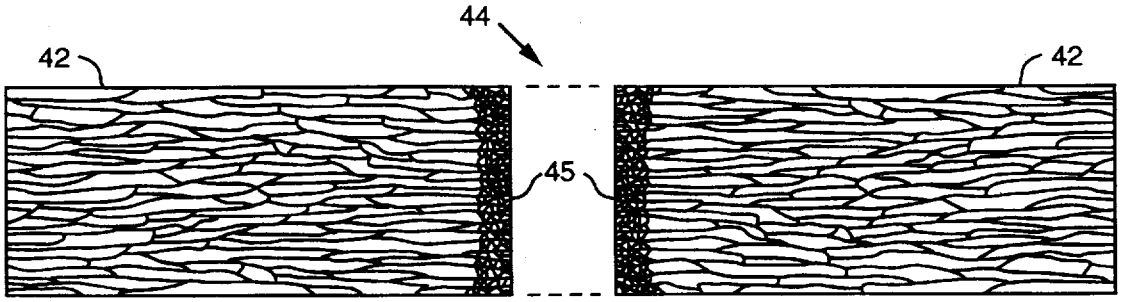
FIG. 4 is a schematic depiction of a hole in the aluminum alloy sheet of FIG. 1 that has been formed by the friction boring process of the present invention to produce a fine grain microstructure in the hole surfaces.
Figure 5:
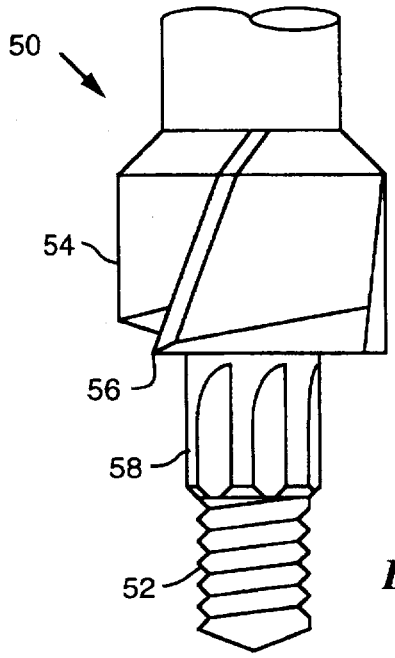
FIG. 5 is a side view of a friction boring tool having a reaming segment and a top surface finishing segment.
Figure 6:
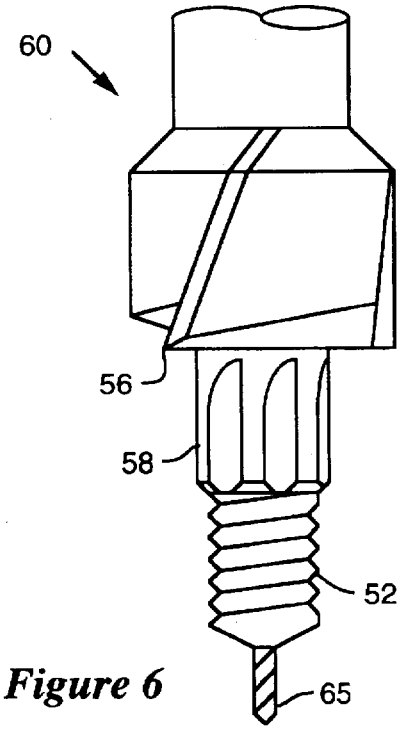
FIG. 6 is a side view of the friction boring tool of FIG. 5 with the addition of a drill bit.
Figure 7:
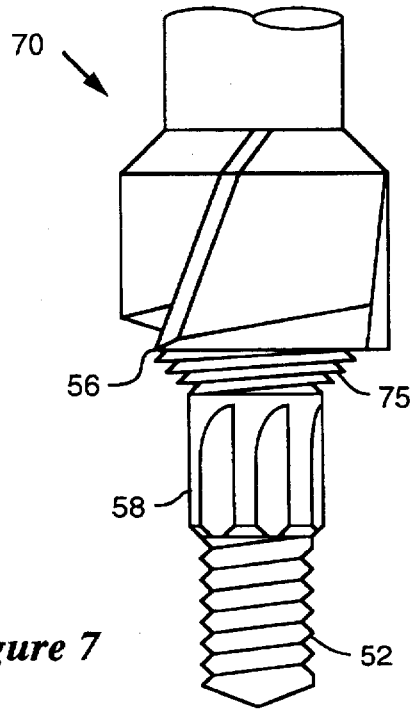
FIG. 7 is a side view of the friction boring tool of FIG. 5 with a countersink friction boring segment.

FIGS. 5–7 illustrate schematic side views of variations in the basic friction boring tool 30 of FIG. 3. In FIG. 5, boring tool 50 includes a boring segment 52, a reaming segment 58, and cutting, grinding, or polishing elements 56 on finishing segment 54. Operation of tool 50 is essentially the same as that of tool 30. Boring segment 52 is inserted directly into aluminum alloy sheet 42 at a sufficient rotational velocity and feed rate to cause frictional heating, stirring, and extraction of aluminum material. Reaming segment 58 follows boring segment 52 into the newly formed hole to accomplish a reaming operation in one step. Cutting, grinding, or polishing elements 56 are positioned to burr, smooth, or otherwise remove extracted material and finish the surface around the bored and reamed hole. Boring tool 50 may be operated by a drive motor (not shown) that allows segments 52, 58, and 54 to be rotated at differing revolutions per minute as they contact the workpiece to optimize their various functions.

Boring tool 60, illustrated schematically in FIG. 6, is a variation of tool 50 that includes a drill bit 65. When tool 60 is inserted into an aluminum alloy component, drill bit 65 performs a cutting action to drill a pilot hole and guide boring segment 52 and reaming segment 58 into the aluminum alloy material. Thus, tool 60 performs pilot hole drilling, hole boring, hole reaming, and top surface finishing in a one step operation. Also like tool 50, the various segments of tool 60, including drill bit 65, can be operated at differing revolutions per minute for optimum performance. Boring tool 70, illustrated schematically in FIG. 7, is another variation of the boring tool of the present invention in which a friction boring countersink segment 75 is combined with boring segment 52 and reaming segment 58 in a single tool. As would be obvious to one having ordinary skill in the art, various combinations of drilling, boring, reaming, countersinking, and finishing segments can be combined in a single tool as desired to complete a particular friction boring operation in a single step.

The boring process of the present invention can be used to form a fine grain microstructure in existing holes as well as in newly bored holes in aluminum alloys. In existing holes, the boring process forms a hole having a larger diameter than the original hole, and the fine grain microstructure does not extend as deeply into the surface as in the newly bored holes described above. Nevertheless, this process has great utility for field repair of worn or corroded holes in aging aircraft structures by removing prior corrosion damage and at the same time forming fine grain corrosion resistant surfaces.

Significantly, the friction boring process of the present invention is not limited to any specific aluminum alloy composition. In particular, fine grain surface microstructures have been formed by friction boring of holes in various materials, including aluminum alloys 2219, 6061, and 7075. Furthermore, friction boring to create localized fine grain microstructures in and around holes is an inexpensive and easy process to implement because it does not require the conventional steps of solution and age treatment, cold working, subsequent heating for recrystallization, and final age treatment. As described above, the process is fast and easily adaptable to initial fabrication of aluminum components or to field repair of assembled components such as existing on aging aircraft.

Although the present invention has been described with respect to specific embodiments thereof, various changes and modifications can be carried out by those skilled in the art without departing from the scope of the invention. Therefore, it is intended that the present invention encompass such changes and modifications as fall within the scope of the appended claims.

I claim:

1. A method of forming a hole having a layer of fine grain microstructure in an aluminum alloy material, comprising the steps of:

inserting a rotating tool into the material;

working, frictionally heating, and extracting a portion of the material with said rotating tool to form the hole; and adjusting the rotational velocity and insertion rate of the tool such that working extends around the hole beyond the diameter of the tool and such that frictional heat generated in the hole causes rapid recrystallization of the worked metal.

2. The method of claim 1, further comprising the step of providing said rotating tool with a boring segment comprising a rotating shaft for said step of working, frictionally heating, and extracting aluminum alloy material.

3. The method of claim 2, further comprising the steps of: providing said rotating tool with a reaming segment; and reaming the hole after said step of extracting aluminum alloy material.

4. The method of claim 2, further comprising the steps of:

providing said rotating tool with a drill bit; and drilling a pilot hole before inserting said boring segment into the aluminum alloy material.

5. The method of claim 2, further comprising the steps of:

providing said rotating tool with a countersink boring segment; and forming a countersunk hole having the fine grain surface microstructure.

6. The method of claim 2, further comprising the steps of:

providing said rotating tool with a finishing segment; and removing aluminum material extracted from the hole and finishing the top surface around the hole with said finishing segment.

7. A method of forming a hole having a layer of fine grain microstructure in an aluminum alloy material, comprising the steps of:

providing a rotating tool having a boring segment comprising a rotating shaft;

inserting said rotating shaft into the material;

working, frictionally heating, and extracting a portion of the material with said rotating boring segment without cutting action to form the hole; and adjusting the rotational velocity and insertion rate of the tool such that working extends around the hole beyond the diameter of the tool and such that frictional heat generated in the hole causes rapid recrystallization of the worked metal.

8. The method of claim 7, further comprising the steps of:

providing said rotating tool with a reaming segment; and reaming the hole after said step of extracting aluminum alloy material with said rotating shaft.

9. The method of claim 7, further comprising the steps of:

providing said rotating tool with a drill bit; and drilling a pilot hole before inserting said rotating shaft for said steps of working, frictionally heating, and extracting aluminum alloy material.

10. The method of claim 7, further comprising the steps of:

providing said rotating tool with a countersink boring segment; and forming a countersunk hole having the fine grain surface microstructure.

11. The method of claim 7, further comprising the steps of:

providing said rotating tool with a finishing segment; and removing aluminum material extracted from the hole and finishing the top surface around said hole with said finishing segment.

12. The method of claim 11, wherein the step of finishing said top surface around said hole comprises at least one of the steps of burring, grinding, smoothing, and polishing.

13. A method of forming a corrosion resistant layer of fine grain microstructure around a hole in an aluminum alloy material, comprising the steps of:

providing a tool having a rotating shaft;

providing said rotating shaft with a boring segment having helical threads;

inserting said rotating boring segment into the material;

working, frictionally heating, and extracting a portion of the material with said rotating boring segment without a cutting action; and adjusting the rotational velocity and insertion rate of the boring segment such that working extends around the hole beyond the diameter of the boring segment and such that frictional heat generated in the hole causes rapid recrystallization of the worked metal.

14. The method of claim 13, further comprising the steps of:

providing said rotating shaft with a finishing segment; and removing aluminum material extracted from the hole and finishing the top surface around the hole with said finishing segment.

15. The method of claim 14, wherein the step of finishing said top surface around the hole comprises at least one of the steps of burring, grinding, smoothing, and polishing.

16. The method of claim 14, further comprising the steps of:

providing a drill bit attached to said boring segment of said rotating shaft; and drilling a pilot hole with said drill bit immediately before the step of inserting said boring segment.

17. The method of claim 14, further comprising the steps of:

providing said rotating shaft with a reaming segment; and reaming the hole after said step of extracting aluminum alloy material with said boring segment.

18. The method of claim 14, further comprising the steps of:

providing said rotating shaft with a countersink boring segment; and forming a countersunk hole having the fine grain surface microstructure.

* * * * *